United States Patent [19]

Scheneman

[11] 4,327,888

[45] May 4, 1982

[54] BRACKETS FOR ATTACHMENT TO PERFORATED PANELS

[75] Inventor: Henry F. Scheneman, Comstock Park, Mich.

[73] Assignee: Markson Manufacturing Company, Grand Rapids, Mich.

[21] Appl. No.: 167,451

[22] Filed: Jul. 10, 1980

[51] Int. Cl.[3] ..... F16M 13/00

[52] U.S. Cl. ..... 248/221.2; 248/222.1

[58] Field of Search ..... 248/73, 220.1, 221.1, 248/221.2, 221.4, 222.2, 220.4, 222.1

[56] References Cited

U.S. PATENT DOCUMENTS

| | | | |
|---|---|---|---|
| 3,037,733 | 6/1962 | Roman | 248/222.1 X |
| 3,229,239 | 1/1966 | Modrey | 248/221.4 X |
| 3,289,994 | 12/1966 | Burmeister | 248/220.4 |
| 3,319,917 | 5/1967 | Bilodeau | 248/221.2 |
| 3,392,949 | 7/1968 | Meyer | 248/221.1 |
| 3,836,105 | 9/1974 | Marschak | 248/551 X |
| 4,048,768 | 9/1977 | Good | 248/222.1 X |
| 4,049,230 | 9/1977 | Minniear | 248/222.1 X |
| 4,143,845 | 3/1979 | Harris | 248/221.2 |

FOREIGN PATENT DOCUMENTS

| | | | |
|---|---|---|---|
| 2640423 | 3/1977 | Fed. Rep. of Germany | 248/221.2 |
| 1226018 | 7/1960 | France | 248/221.2 |

*Primary Examiner*—William H. Schultz
*Attorney, Agent, or Firm*—Glenn B. Morse

[57] ABSTRACT

The present invention provides a modified configuration of the outer plate of the system shown in U.S. Pat. No. 3,545,711 to facilitate installation, and also provides further developments in brackets for special purposes. One of these brackets incorporates an angular shelf support utilizing the primary attachment assembly for securing the horizontal beam, and which has a diagonal engageable at its lower extremity with a lower board perforation only prior to the securing of the horizontal beam. Another attachment has a bracket provided with laterally-spaced flanges embracing the inner and outer plates to maintain the alignment of the bracket.

7 Claims, 9 Drawing Figures

BRACKETS FOR ATTACHMENT TO PERFORATED PANELS

BACKGROUND OF THE INVENTION

Panels of standard thickness having regularly-spaced holes have come into wide use to provide support for a variety of specialized brackets adapted to engage these holes. A piece of so-called "perfboard" equipped with these brackets can be used for the display of merchandise, for the storage of tools and miscellaneous items, and is easily adapted to particular items of odd configuration. Many of these standard brackets merely hook into the holes, and are thus vulnerable to jostling. My prior U.S. Pat. No. 3,545,711 provides an arrangement for securing a bracket positively to the perfboard, thus eliminating the possibility of accidental disengagement. In the arrangement disclosed in this patent, overlapped plates are each equipped with offsets adapted to engage the holes of the perfboard when the plate is in a position generally perpendicular to the surface of the board. As the units are then laid flat against the board, they are secured together so that they are no longer disengageable. This arrangement has been very satisfactory, but a need has been recognized to facilitate the installation of the overlapped plates and the threaded member that secures them in position. The need for alignment of the holes in the two plates so that the screw can be installed requires somewhat more attention than is desirable. The present invention provides a modified configuration for the outer plate which removes this problem entirely, and also provides further developments in the construction of brackets for special purposes that utilize the basic assembly shown in the above patent.

SUMMARY OF THE INVENTION

The outer plate of a bracket-support assembly of the type shown in U.S. Pat. No. 3,545,711 is modified to permit the prior assembly of a screw to the threaded inner plate, followed by the installation of the inner and outer plates in the vertically spaced holes in the perfboard. The outer plate is then swung into position in a pivotal movement centering in the engaged hole in the perfboard, as a result of a laterally-open slot extending to the edge of the plate, for receiving the screw during this pivotal movement. This modified assembly is the preferred support terminal for a shelf bracket having a horizontal arm provided with a keyhole-shaped opening for receiving the screw, this bracket also having a diagonal provided with an offset end engageable with a lower hole in the perfboard only prior to the securing of the screw. Another bracket provides laterally-spaced flanges on a position to embrace the overlapped inner and outer plates to maintain the vertical alignment of the bracket with the single attachment screw.

DESCRIPTION OF THE PREFERRED EMBODIMENTS

Figure 1:
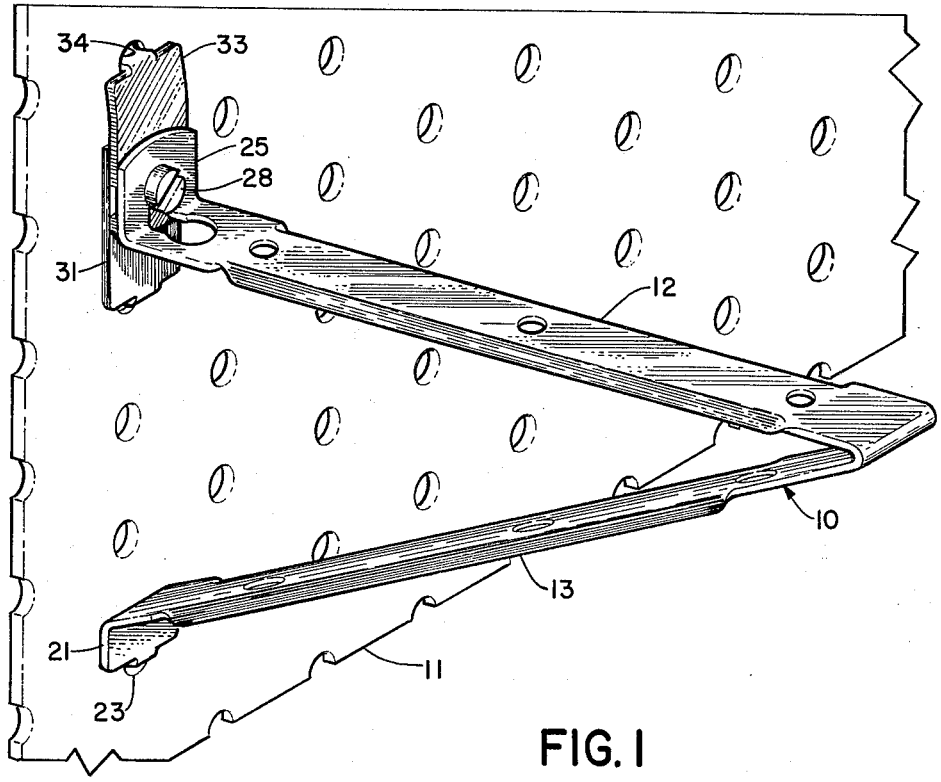
FIG. 1 is a perspective view showing a shelf bracket embodying the present invention installed on a piece of perfboard.
Figure 3:
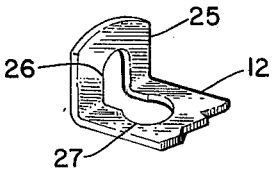
FIG. 3 is a fragmentary section showing the inner extremity of the horizontal portion of the shelf bracket, to illustrate the position of the keyhole opening.
Figure 2:
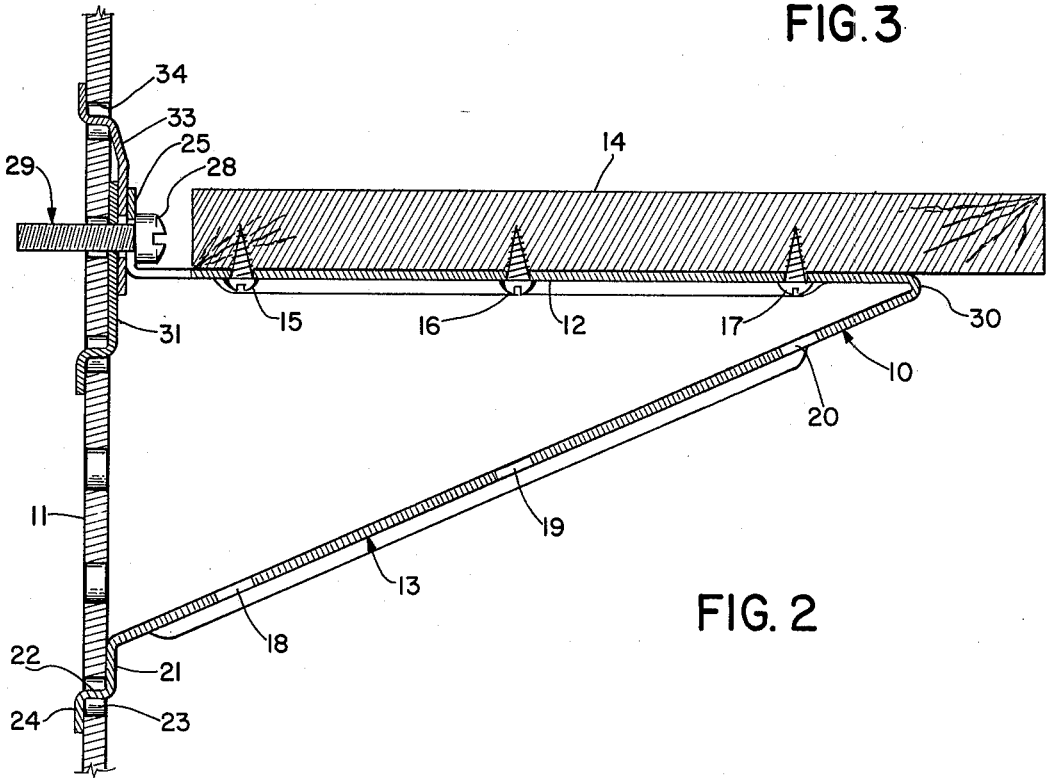
FIG. 2 is a section on the vertical plane through the installation illustrated in FIG. 1.

Referring to FIGS. 1 and 2, the shelf bracket generally indicated at 10 is shown installed on a piece of standard perfboard 11. The shelf support has a horizontal arm 12 and a diagonal arm 13 joined at the outer extremity to present the usual angular configuration. A board 14 is secured in position on the arm 12 with wood screws as shown at 15–17, these being installed by a screwdriver through the access holes 18–20 in the diagonal member 13.

The inner extremity of the diagonal member 13 has a portion 21 disposed to bear against the surface of the perfboard 11. An offset in the end of the portion 21 indicated at 22 traverses the hole 23 in the perfboard, and also provides the portion 24 that engages with the back surface of the perfboard 11 when the unit is in the fully installed position shown in FIGS. 1 and 2. The portions 22 and 24 are engageable with the hole 23 only with the diagonal arm 13 rotated clockwise at least approximately forty-five degrees. Once the unit is then rotated into the illustrated installed position, it is obvious that the perfboard is gripped solidly by the portions 21 and 24.

The inner extremity of the horizontal arm 12 provides a flange 25 parallel to the surface of the perfboard 11 when the unit is fully installed. A keyhole opening has its narrow portion 26 primarily in the flange 25, and the wider portion 27 in the horizontal portion of the arm 12. The wider portion is capable of receiving the head 28 of the screw 29 when the screw is backed off somewhat from its fully installed position illustrated in FIGS. 1 and 2. The angular flexibility of the shelf bracket, particularly about the outer junction 30, permits the lower extremity of the diagonal to be installed in the hole 23 as previously described, and yet allow for the angular articulation necessary in engaging the keyhole opening with the head 28 of the screw.

Figure 4:
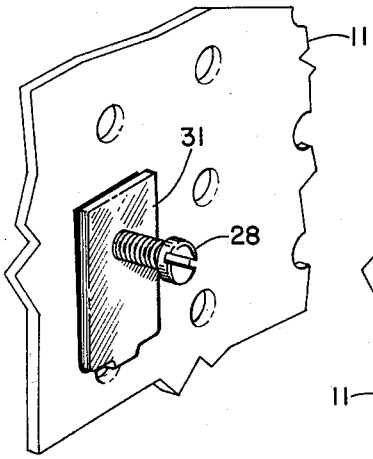
FIG. 4 is a view showing the first step in the installation of the primary attachment components, with the lower plate engaged in the perfboard and in its final position.
Figure 5:
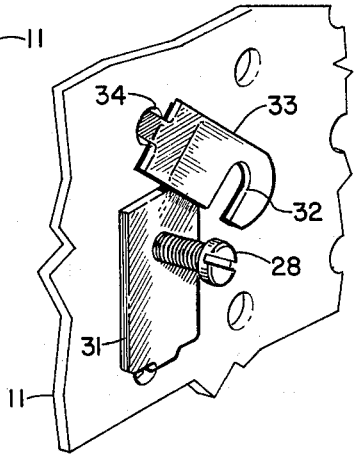
FIG. 5 shows the first step in the installation of the outer plate, this member being engaged in the perfboard in a position angularly displaced from the vertical.
Figure 6:
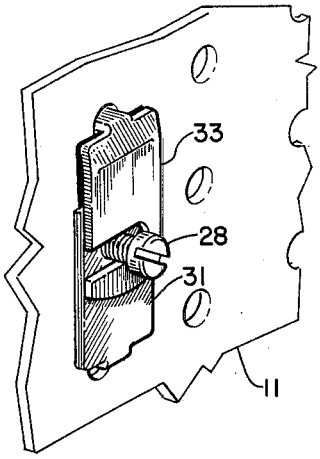
FIG. 6 illustrates the subsequent position of the outer plate, as it is pivoted into position engaging the attachment screw.

The tightening of the screw 29 results in the final securing of the bracket assembly. The screw 29 has threaded engagement with a hole in the inner plate 31, the lower end of which engages the perfboard in the same manner as the inner extremity of the diagonal 13. The regularly-spaced holes in the perfboard provide clearance for the screw 29, which is also freely received in the laterally-open slot 32 in the outer plate 33 (refer particularly to FIG. 5). This plate also has an offset end engageable with a hole in the perfboard, as previously described. The installation sequence is shown in FIGS. 4, 5 and 6. The placement of the inner plate 31 in the installed position also has the effect of engaging the inner end of the screw 29 with its associated hole in the perfboard. This sub-assembly will hold its position while the outer plate is installed in a position angularly displaced from its finally assembled position, as shown in FIG. 5. The outer plate 33 is then swung down into the FIG. 6 position, pivoting about the hole 34. Both the inner and outer plates are engaged with the respective holes in the perfboard in positions initially inclined to the perfboard. When finally in positions generally parallel to the perfboard, as shown in FIG. 6, the engaged ends cannot be withdrawn. The shelf bracket is then engaged with the perfboard as previously described, and the keyhole opening slipped over the head 28 of the screw 29. Tightening of this assembly prepares the unit for receiving the board 14 and the screws 15–17.

Figure 7:
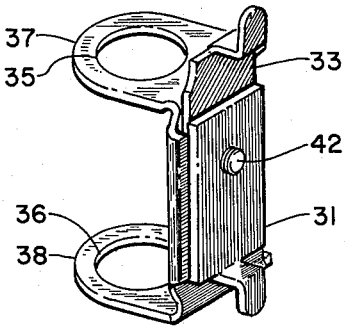
FIG. 7 shows a modification of the invention involving a bracket with laterally-spaced flanges for embracing the inner and outer plates.
Figure 8:
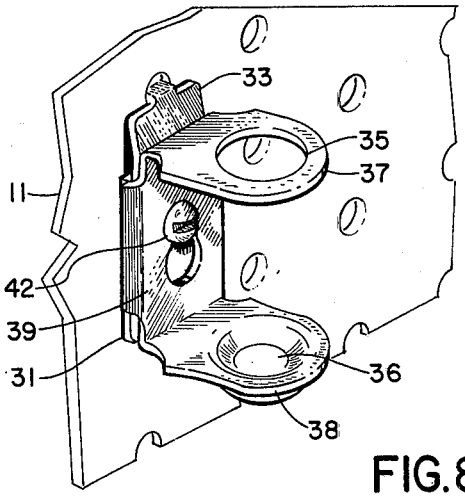
FIG. 8 is a perspective view from the opposite side of the assembly shown in FIG. 7.
Figure 9:
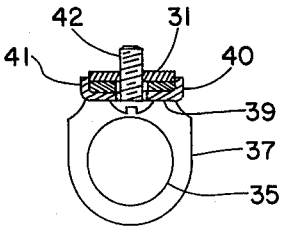
FIG. 9 is a section on a horizontal plane through the central portion of FIG. 7.

The modification shown in FIGS. 7 through 8 provides a bracket for receiving a variety of tools, such as screwdrivers, that can be engaged with the holes 35 and 36 in the upper and lower sections 37 and 38, respectively. This bracket utilizes the same inner and outer plate and securing screw as that shown in FIGS. 4 through 6. The bracket shown in FIGS. 7 and 8 has a central planar portion 39 having a laterally-spaced flanges 40 and 41 embracing the edges of the overlapped plates 31 and 33. The attachment screw 42 performs the same function as that of the screw 29. This overlapped and embracing relationship maintains the vertical alignment of the bracket with a single attachment screw.

I claim:

1. In combination with a panel having regularly spaced apertures, an attachment assembly including inner and outer plates each having an offset end providing a portion normal to said plate and adapted to traverse the thickness of said panel, and a portion disposed to engage the opposite side of said panel from the plate associated therewith with said plate approaching parallelism with said panel, said portions being insertable in one of said apertures with said plate inclined with respect to said panel, the opposite ends of said plates from said offset ends being adapted to overlap and having alignable openings when said offset ends are respectively engaged in spaced apertures, and also including a member freely traversing said opening in the outer of said overlapped ends and in threaded engagement with the inner of said overlapped ends at said opening therein, wherein the improvement comprises:

a configuration of said outer overlapped end wherein said opening extends laterally to the edge of said plate, and aligned to provide for rotary engagement of said plate with said member by pivotal movement of said outer plate about the aperture of said panel engaged by said outer plate.

2. An assembly as defined in claim 1, additionally including a shelf bracket having a horizontal arm and an inclined arm joined to said horizontal arm at the outer extremity thereof, said member having a head portion, and said horizontal arm having a keyhole opening in the inner extremity thereof, at least a part of a relatively narrow portion of said opening being disposed in a portion of said inner end normal to the outer portion of said horizontal arm, and the inner extremity of said diagonal portion having an offset adapted to engage one of said apertures.

3. An assembly as defined in claim 1, additionally including a tool bracket having spaced flanges receiving at least portions of said inner and outer plates therebetween, said tool bracket having a planar central portion provided with an aperture receiving said member.

4. An assembly as defined in claim 3, wherein said central portion aperture is keyhole-shaped, and elongated in a direction parallel to said flanges, said member having a head receivable in a relatively wide portion of said central portion aperture.

5. In combination with a panel having regularly spaced apertures, an attachment assembly including inner and outer plates each having an offset end providing a portion normal to said plate and adapted to traverse the thickness of said panel, and a portion disposed to engage the opposite side of said panel from the plate associated therewith with said plate approaching parallelism with said panel, said portions being insertable in one of said apertures with said plate inclined with respect to said panel, the opposite ends of said plates from said offset ends being adapted to overlap and having alignable openings when said offset ends are respectively engaged in spaced apertures, and also including a member freely traversing said opening in the outer of said overlapped ends and in threaded engagement with the inner of said overlapped ends at said opening therein, wherein the improvement comprises:

a shelf bracket having a horizontal arm and an inclined arm joined to said horizontal arm at the outer extremity thereof, said member having a head portion, and said hoizontal arm having a keyhole opening in the inner extremity thereof, at least a part of a relatively narrow portion of said opening being disposed in a portion of said inner end normal to the outer portion of said horizontal arm, and the inner extremity of said diagonal portion having an offset adapted to engage one of said apertures.

6. In combination with a panel having regularly spaced apertures, an attachment assembly including inner and outer plates each having an offset end providing a portion normal to said plate and adapted to traverse the thickness of said panel, and a portion disposed to engage the opposite side of said panel from the plate associated therewith with said plate approaching parallelism with said panel, said portions being insertable in one of said apertures with said plate inclined with respect to said panel, the opposite ends of said plates from said offset ends being adapted to overlap and having alignable openings when said offset ends are respectively engaged in spaced apertures, and also including a member freely traversing said opening in the outer of said overlapped ends and in threaded engagement with the inner of said overlapped ends at said opening therein, wherein the improvement comprises:

a tool bracket having spaced flanges receiving at least portions of said inner and outer plates therebetween, said tool bracket having a planar central portion provided with an aperture receiving said member.

7. An assembly as defined in claim 6, wherein said central portion aperture is keyhole-shaped, and elongated in a direction parallel to said flanges, said member having a head receivable in a relatively wide portion of said central portion aperture.

* * * * *